United States Patent [19]

Kobayashi et al.

[11] Patent Number: 4,608,317

[45] Date of Patent: Aug. 26, 1986

[54] MATERIAL SHEET FOR METAL SINTERED BODY AND METHOD FOR MANUFACTURING THE SAME AND METHOD FOR MANUFACTURING METAL SINTERED BODY

[75] Inventors: Osamu Kobayashi, Tokyo; Hiroshi Sasaki, Hatoyama; Toshiki Kaneko, Kawagoe; Hideaki Ikeda, Iruma; Yoshihisa Yamamura, Sayama, all of Japan

[73] Assignee: Honda Giken Kogyo Kabushiki Kaisha, Tokyo, Japan

[21] Appl. No.: 723,030

[22] Filed: Apr. 15, 1985

[30] Foreign Application Priority Data

| | | | |
|---|---|---|---|
| Apr. 17, 1984 | [JP] | Japan | 59-77117 |
| Jun. 8, 1984 | [JP] | Japan | 59-117928 |
| Jun. 19, 1984 | [JP] | Japan | 59-125484 |

[51] Int. Cl.[4] ..... B22F 3/00

[52] U.S. Cl. ..... 428/546; 75/228; 75/246; 75/248; 75/252; 264/57; 264/63; 264/126; 264/127; 264/332; 419/10; 419/18; 419/25; 419/37; 419/47; 419/60; 419/65; 419/66

[58] Field of Search ..... 419/36, 37, 47, 10, 419/64, 18, 65, 25, 66, 60; 425/546; 75/228, 246, 248, 252; 264/57, 63, 126, 127, 332

[56] References Cited

U.S. PATENT DOCUMENTS

| | | | |
|---|---|---|---|
| 3,706,550 | 12/1972 | Umehara et al. | 419/47 |
| 3,743,556 | 7/1973 | Breton et al. | 419/47 |
| 3,841,846 | 10/1974 | Larsen et al. | 419/47 |
| 3,937,630 | 2/1976 | Kimura et al. | 419/47 |
| 4,343,650 | 8/1982 | Rivers | 419/33 |
| 4,563,329 | 1/1986 | Morishita et al. | 419/9 |

*Primary Examiner*—Stephen J. Lechert, Jr.
*Attorney, Agent, or Firm*—Armstrong, Nikaido, Marmelstein & Kubovcik

[57] ABSTRACT

A method for manufacturing a metal sintered body disclosed herein is characterized by the use of steps of: mixing 70 to 90 weight % of self-fluxing alloy powder and 10 to 30 weight % of metal powder of high melting point having a higher melting point than that of the self-soluble metal powder and in which the self-fluxing alloy powder is liable to be deposited thereon to obtain a metal powder having a sintering property; using a material in which 1 to 10 weight % of plastic binder is kneaded with the metal powder having a sintering property to obtain a molded body having a predetermined shape; and sintering the molded body at a temperature in excess of a liquid phase line of the self-fluxing alloy powder.

26 Claims, 7 Drawing Figures

MATERIAL SHEET FOR METAL SINTERED BODY AND METHOD FOR MANUFACTURING THE SAME AND METHOD FOR MANUFACTURING METAL SINTERED BODY

BACKGROUND OF THE INVENTION

1. Field of the Invention

The present invention relates to a material sheet for a metal sintered body and a method for manufacturing the same and a method for manufacturing a metal sintered body.

2. Description of the Prior Art

In the past, where a metal sintered body is manufactured, there has been proposed a method, in order to carry out molding operation thereof, which comprises using a plasticizing material wherein a metal powder having a sintering property and a plastic binder are kneaded, molding the plasticizing material into a predetermined configuration, subjecting the plastic binder in a molded body to thermal decompostion and sintering the metal powder.

In the aforesaid method, the sintered body gives rise to a change in size due to expansion unless some back-up means is taken when the metal powder is sintered, and a deviation of nearly 4% before and after sintering possibly occurs.

As the metal powder having a sintering property, a self-fluxing alloy powder, for example, Ni self-fluxing alloy metal powder of Ni-B-Si family. However, the solid phase line of this alloy is 1010°–1020° C. and the liquid phase line thereof is 1075° to 1085°C. When sintering is effected at a zone of lower temperature than the solid phase line, a contour maintaining property is good but a sintering strength is low whereas when sintering is effected at a zone of higher temperature than the liquid phase line, all powders become molten and flow, as a result of which the contour maintaining property is worsened.

In view of the foregoing, sintering is effected at a suitable temperature between the solid phase line and the liquid phase line, for example, at a temperature in the vicinity of 1050° C.

However, in the case where sintering is effected at the above-described temperature, the sintered body shows a change in size due to shrinkage, deteriorating accuracy in size and the sintering strength is not so high.

Further, there has been proposed a method in which the aforesaid plasticizing material is formed into a sheet to prepare a material sheet, which sheet is used to obtain a metal sintered body. In this case, however, a stacking property of the material sheet is deteriorated depending on quality of the plastic binder and therefore there poses problems in that peeling between layers of the molded body occurs and cracks occur.

SUMMARY OF THE INVENTION

It is an object of the present invention to provide the aforesaid manufacturing method which can obtained the aforesaid metal sintered body which has a good precision in size and which has a high strength.

It is a further object of the present invention to provide the aforesaid manufacturing method which can control expansion of metal sintered body by simple means.

It is another object of the present invention to provide said material sheet and method for the manufacture thereof which is excellent in stacking and developing property, which produces no peeling and which is excellent in anti-cracking property.

In order to achieve the above-described objects, in accordance with the present invention there is provided a method for manufacturing a metal sintered body, the method comprising the steps of mixing 70 to 90 weight % of self-fluxing alloy powder and 10 to 30 weight % of metal powder of high melting point having a higher melting point than that of said self-fluxing metal powder and in which said self-fluxing alloy powder is liable to be deposited thereon to obtain a metal powder having a sintering property; using a material in which 1 to 10 weight % of plastic binder is kneaded with said metal powder having a sintering property to obtain a molded body having a predetermined shape; and sintering said molded body at a temperature in excess of a liquid phase line of said self-fluxing alloy powder.

Further, in accordance with the present invention there is provided a method for manufacturing a metal sintered body, the method comprising the steps of: mixing 70 to 90 weight % of self-fluxing alloy powder and 10 to 30 weight % of metal powder of high melting point having a higher melting point than that of said self-fluxing metal powder and in which said self-fluxing alloy powder is liable to be deposited thereon to obtain a metal powder having a sintering property; using a material in which 1 to 10 weight % of plastic binder is kneaded with said metal powder having a sintering property to obtain a molded body having a predetermined shape; and sintering said molded body at a temperature in excess of a liquid phase line of said self-fluxing alloy powder in the state where the surface of said molded body is covered with back-up bodies.

In addition, in accordance with the present invention there is provided a method for manufacturing a metal sintered body, the method comprising the steps of molding a plasticizing material in which a metal powder having a sintering property and a plastic binder are kneaded into a predetermined shape to obtain a molded body; surrounding said molded body by a granular back-up body; and subjecting the plastic binder in said molded body to thermal decomposition and sintering said metal powder Moreover, in accordance with the present invention there is provided a material sheet for a metal sintered body which comprises a metal powder having a sintering property and a plastic binder including a thermoplastic synthetic resin excellent in anti-crakcing property and a thermoplastic synthetic resin excellent in stacking property.

Furthermore, in accordance with the present invention there is provided a method for manufacturing a material sheet for a metal sintered body, the method comprising the steps of kneading a metal powder having a sintering property and a liquid plastic binder including a thermoplastic synthetic resin excellent in anti-cracking property and a thermoplastic synthetic resin excellent in stacking property to obtain a plasticizing material; heating and drying said plasticizing material; and molding said plasticizing material into the form of a sheet in the thermoplasticized state.

Since said specific quantity of metal powder having a higher melting point than that of the self-fluxing alloy powder is mixed with the latter as described above, even if the self-fluxing alloy powder is sintered at a temperature in excess of a liquid phase line thereof, the flow of the self-fluxing alloy is impaired by the metal power having a high melting point whereby a metal sintered body having a good shape maintenance and precision in size may be obtained. In addition, it is possible to obtain a metal sintered body which is excellent in bonding property between the self-fluxing alloys and intertwining and deposition between the self-fluxing alloy and the metal powder of high melting point and which has a high strength.

Furthermore, since the aforesaid specific quantity of plastic binder is kneaded with the mixture of the self-fluxing alloy powder and the metal powder of high melting point, even if molding pressure is low, a molded body excellent in shape maintenance may be obtained. In case where a metal sintered body integrally bonded to parent metal, it is possible to easily carry out attaching work of the mixed powder to the parent metal, molding work of the mixed powder and the like.

Moreover, since a molded body obtained from a mixture of the self-fluxing alloy powder and metal powder of high melting point is sintered in the state wherein the surface thereof is covered with a back-up body, the back-up body controls a change in size of the metal sintered body to further improve the precision in size.

In addition, by extremely simple means which surrounds a molded body formed of a plasticizing material with a granular back-up body, it is possible to control a change in size of a metal sintered body resulting from expansion to obtain a metal sintered body which is excellent in precision in size.

Since a thermoplastic synthetic resin excellent in anti-cracking property and a thermoplastic synthetic resin excellent in stacking property are included in a plastic binder of a material sheet, peeling between layers does not occur nor cracking generates in a molded body obtained from the material sheet. It is possible to obtain a molded body which is great in adhesive strength between layers and excellent in surface quality, and to obtain a metal sintered body which is excellent in precision in size and surface quality.

Further, in the manufacture of the material sheet, a metal powder having a sintering property and a liquid plastic binder having the aforesaid specific quality are kneaded to obtain a plasticizing material, and then said plasticizing material is heated and dried to thereby uniformly coat a small quantity of plastic binder on the metal powder having a sintering property. By uniformly coating the plastic binder on the metal powder havng a sintering property in a manner as described, it becomes possible to obtain a sheet excellent in shape maintenance in the sheet molding operation in the subsequent step. Also, by using a small quantity of plastic binder, it is possible to obtain a metal sintered body which is small in porosity and which has a high strength.

A plasticizing material is molded into a sheet in the thermoplasticized state to thereby facilitate molding operation thereof, and it is possible to obtain a material sheet which has suitable flexibility and internal tearing resistance at a normal temperature and which is excellent in handling property.

The above-described and other objects, features and advantages of the present invention will be apparent from the description of the preferred embodiments which will be described in detail with reference to the accompanying drawings.

BRIEF DESCRIPTION OF THE DRAWINGS

FIG. 1 is a sectional view of a mold for a press, FIG. 2 illustrates the steps of manufacturing the mold for a press and FIG. 3 is a graph showing the relation between the temperature and time in the sintering step.

DESCRIPTION OF PREFERRED EMBODIMENTS

Figure 1:
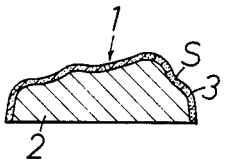
FIGS. 1 to 3 show a first embodiment according to the present invention.

Self-soluble alloy powders among metal powders having a sintering property used in the present invention include self-fluxing alloy powders such as Ni family, Co family, Fe family and the like. In order that a sintering temperature of the self-fluxing alloy powder is set to a temperature in excess of a liquid phase line of alloy thereof to enhance the strength of a metal sintered body, metal powder having a high melting point which is higher in melting point than that of self-fluxing alloy powder and in which self-fluxing metal powder is liable to be deposited thereon is added as metal powder having a sintering property to self-fluxing alloy powder to impair the flow of the self-fluxing alloy by the metal of high melting point to improve the shape maintaining property. In this case, the metal powder having a high melting point includes either of powders such as Mo, W, stainless steel, WC, Fe—Mo (ferromolybdenum) or a mixture thereof.

Thermoplastic synthetic resins excellent in anti-cracking property in the material sheet include tetrafluoride ethylene resin, polystyrene resin, nylon and the like, and synthetic resins excellent in stacking property include acrylic resin, polyethylene resin, butadiene vinyl acetate copolymer and the like.

EXAMPLE I (Manufacture of material sheet)

80 wt % of Ni self-fluxing alloy powder having a diameter of 10 to 60 μm and 20 wt % of Mo pulverized powder having a diameter of 10 to 53 μm are mixed by a V-blender for 30 minutes to obtain a mixed powder.

Tetrafluoride ethylene resin emulsion and acrylic resin emulsion are mixed in the ratio of 1:1 to obtain a liquid-like synthetic resin binder.

3 wt % of synthetic resin binder are added to the aforesaid mixed powder and the resultant mixture is kneaded by a bench kneader for five minutes at a normal temperature to obtain a plasticizing material. In this case, the synthetic resin binder is of the emulsion type and therefore has a good scattering property, and a small quantity of synthetic resin binder may be uniformed scattered in the mixed powder during the kneading operation for a short period of time.

A heating device such as a drying furnace, a heater or the like is used to heat the plasticizing material to a temperature of 80 to 120° C. to vaporize water in the synthetic resin binder to dry the plasticizing material.

The obtained plasticizing material presents numberless lumps caked by the synthetic resin binder, and the mixed powder is uniformly coated by the synthetic resin binder.

After being dried, the plasticizing material in the thermoplasticized state while retaining heat of approximately 80° C. is passed through a roll machine, which is provided with rolls having a diameter of 245 mm and a length of 215 mm, several times in X and Y directions to form three kinds of material sheets, i.e., thickness of 1 mm, 1.5 mm and 3 mm. The molding pressure is 0.5 kg/mm$^2$ in density conversion with a test piece obtained by pressure molding. In this case, if the rolls of the roll machine are heated to a temperature (approximately 80° C.) which is almost the same as that of the plasticizing material, the molding operation property for the material sheet may be improved.

After being molded, the material sheet is subjected to heat treatment for 30 minutes at 80° C. to remove strains generated at the time of molding.

The thus obtained material sheet has an adequate flexibility and tearing strength at a normal temperature.

Suitable quantity of addition of the synthetic resin binder to the mixed powder is 1 to 10 wt %. If the adding quantity of the synthetic resin binder is lower than 1 wt %, it is not possible to effect sheet molding, whereas if the adding quantity is above 10 wt %, the porosity of the metal sintered body increases to fail to obtain a metal sintered body of high strength.

In the synthetic resin binder, suitable quantity of addition of the thermoplastic synthetic resin excellent in stacking property to the thermoplastic synthetic resin excellent in anti-cracking property is 30 to 70 wt %. If the quantity of the thermoplastic synthetic resin excellent in stacking property is lower than 30 wt %, peeling between layers occurs between stacked material sheets, whereas if the quantity is above 70 wt %, cracks occur in the surface of a molded body when the latter is molded.

EXAMPLE II (Manufacture off a mold for a press using said material sheet)

Figure 2:
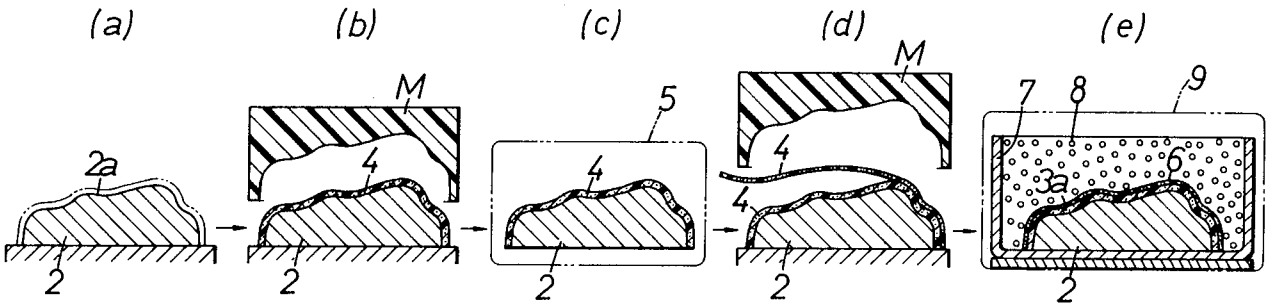

FIG. 1 shows a mold 1 for a press to mold a tank, the mold comprising a base material 2 cast of cast steel (JIS SC46 material) and a work processing portion 3 comprising a metal sintered body S deposited on the base material 2. As shown in FIG. 2 (*a*), a base surface 2*a* of the base material 2 is molded to be lowered 5 to 20 mm than the external surface (shown by the chain lines) of the work processing portion 3 in the completed mold 1. The base material 2 is cast and used, and the base surface 2*a* formed with a mill scale undergoes sand blasting and cleaning, after which an acrylic resin adhesive is coated thereon.

As shown in FIG. 2 (*b*), three material sheets 4 each having a thickness of 3 mm are superposed and adhered to the base surface 2*a*, and the material sheets 4 are pressed by a plastic die mounted on a press machine or the like to check a state of engagement of the die M with the material sheet. If the die M engages the material sheet 4 in many points, the material sheet 4 is shaved, and if no engagement is present, a material sheet 4 is newly adhered. Pressing of the die M, shaving and adhering of the material sheet 4 are repeatedly effected to substantially conform the shape of the stacked material sheets 4 to the shape of the die M. The thus molded stacked material sheet 4 is great in bonding strength between layers and has a good surface property without occurrence of cracking. In this case, the pressing force of the die M is 0.2 to 0.3 kg/mm$^2$.

As shown in FIG. 2 (*c*), both the stacked material sheet 4 and base material 2 are placed in a heating furnace 5 and heated to 80° C. to plasticize the stacked material sheet 4.

As shown in FIG. 2 (*d*), a material sheet 4 having a thickness of 3 mm is further stacked on and adhered to the plasticized stacked material sheet 4, and the obtained stacked material sheet 4 is pressed by the die M with a pressing force of 0.7 kg/mm$^2$ to mold a molded body 3*a* having the same shape as that of the work processing portion 3.

In this case, in order to obtain a better releasing property of the die M from the molded body 3*a*, talc powder is coated on the die M, or an extremely thin film such as polyvinylidene chloride, polyvinyl chloride, polyethylene resin or the like is interposed between the die M and the stacked material sheet 4.

After molding operation has been finished, when temperatures of the base material 2 and molded body 3*a* are cooled to the normal temperature, extra portions are removed from the molded body 3*a*.

As shown in FIG. 2 (*e*), an aluminum sheet 6 having a thickness of 1 mm is stacked on the molded body 3*a* and the base material 2 is placed in a container 7, and steel balls 8 having a diameter of 0.75 mm as back-up bodies are introduced into the container 7. This alumina sheet 6 is comprised of alumina powder and a synthetic resin binder similar to that previously described and has a function to impair a transfer of a rugged rough surface resulting from the numberless steel balls 8 to the molded body 3*a* to prevent the surface roughness of the metal sintered body S from lowered. The steel balls 8 controls, by their weight, a change in size, i.e., expansion of a metal sintered body S when Ni self-fluxing alloy—Mo powder are sintered which will be described later.

Figure 3:
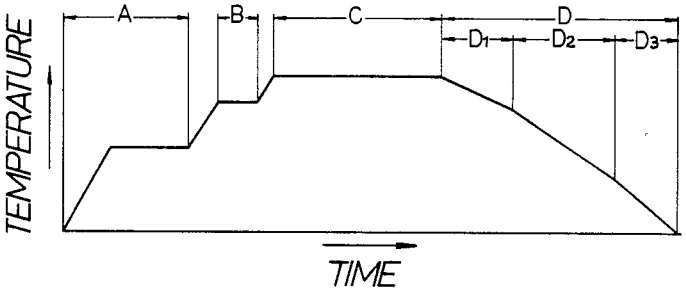

Next, the aforesaid base material 2 is placed in a vacuum sintering furnace 9 to effect decomposition of organic material and sintering of Ni self-fluxing alloy and Mo powder under the heating and cooling conditions as shown in FIG. 3. Carrier gases used are nitrogen gas or hydrogen gas having a high reducing property.

(A) First Heating Zone (FIG. 3A)

This heating zone A is from normal temperature to 650° C., and rates of temperature increase are 10 to 20° C./min. In the heating zone A, first water is vaporized and then tetrafluoride ethylene resin and acrylic resin within the synthetic resin binder in the molded body 3*a* and alumina sheet 6 are decomposed and gasified. These synthetic resins are gasified at 300° to 400° C. but are maintained at 600° to 650° C. for 90 minutes in consideration of heat conduction to remove most of organic matters leaving Ni self-fluxing alloy-Mo powder. The gasification of the organic matter will be described with respect to a change in degree of vacuum within the vacuum sintering furnace 9. At normal temperature the degree of vacuum is 1 Torr but when maintaining at soaking level for 90 minutes at 650° C., the degree of vacuum is lowered to 2 Torr at the maximum. This principally results from creation of cracked gas of organic matter. After a lapse of 90 minutes, the degree of vacuum again rises to 1 Torr and this means that the cracked gas is removed from the vacuum sintering furnace.

(B) Second Heating Zone (FIG. 3B)

This heating zone B is from 900° to 1000° C., and Ni self-fluxing alloy-Mo powder are maintained at soaking level for 30 minutes at a temperature less than the solid phase line (1010°-1020° C.) of Ni self-fluxing alloy, for example, at 950° C. for solid phase sintering process, which is then subjected to temporary sintering. Rates of temperature increase from the first heating zone A are 10° to 20° C./min.

Ni self-fluxing alloy-Mo powder within the vacuum sintering furnace 9 are heated from its surface to increase the temperature thereof, and therefore it requires a predetermined heating time till the whole powder reaches an even temperature. If it is heated abruptly to 1000° to 1200° C. which is a sintering temperature, there occurs a difference in temperature between the surface portion of the Ni self-fluxing alloy-Mo powder and the portion in contact with the base surface 2*a* not only to increase irregularities of porosity failing to obtain even metal sintered body but tend to bring forth drawbacks such as cracks after being sintered.

In the second heating zone B, uncracked organic matter is completely gasified and removed. Due to the aforesaid gasification or the like, the degree of vacuum within the vacuum sintering furnace 9 is temporarily lowered to 4 Torr but after a lapse of 30 minutes, it is returned to 1 Torr.

(C) Third Heating Zone (FIG. 3C)

This heating zone C is in the range of a temperature from a level immediately below the solid phase line (1010° to 1020° C.) to a level in excess of the liquid phase line (1075° to 1085° C.) of Ni self-fluxing alloy, that is, from 1000° to 1200° C. Ni self-fluxing alloy-Mo temporarily sintered body are maintained at a thermostatic level for 120 minutes at 1100° to 1180° C. which is a temperature above the liquid phase line, preferably 1160° C. for liquid-phase sintering process by the melting of Ni self-fluxing alloy to form a metal sintered body. In this case, the flow of Ni self-fluxing alloy is impaired by the presence of Mo and therefore a good shape maintaining property is obtained. Rates of temperature increase from the second heaating zone B are 15° to 20° C./min., and Ni self-fluxing alloy-Mo temporary sintered body have already been heated at high temperature in the second heating zone B and therefore, time of temperature increase up to the third heating zone C is short. If retaining time in the third heating zone C is insufficient, sintering cannot be preformed completely to bring forth a defect in a metal sintered body S.

The reason why the sintering temperature is selected to be 1160° C. is that when the sintering temperature is 1200° C. or so, a change in size of the sintered body S increases, it is not easy to control furnace temperature and in addition the temperature in the furnace is uneven, and a temperature of 1160° C. is suitable for operation to remove these inconveniences.

(D) Cooling Zone (FIG. 3D)

This cooling zone D is divided into a first cooling zone $D_1$ from the aforesaid sintering temperature to approx. 80° C., a second cooling zone $D_2$ from approx. 800° C. to approx. 400° C., and a third cooling $D_3$ from approx. 400° C. to normal temperature.

The first cooling zone $D_1$ is a stabilized zone under high temperature of the metal sintered body S. In this cooling zone $D_1$, thermal stimulation is avoided as much as possible, and at the same time, cooling takes place at a slow speed, say 2° C./min. at the maximum in consideration of cooling efficiency. If quick cooling takes place in the cooling zone $D_1$, cracks often occur in the metal sintered body S.

In the second cooling zone $D_2$, cooling takes place at a slow speed, say 3° C./min. at the maximum in order to absorb a linear expansion of the base material 2 and a change in size in transformation. In this case, a linear shrinkage of the metal sintered body S is $14.6\times10^{-6}$ but follows a shrinkage of the base material 2 due to the porosity. When quick cooling takes place in the cooling zone $D_2$, cracks often occur in the metal sintered body S.

In the third cooling zone $D_3$, temperatures of the metal sintered body S and base material 2 are cooled to normal temperature by gas cooling (including air cooling) other than liquid cooling such as water, oil and the like.

Upon the aforementioned heating-cooling processes, there is obtained a mold 1 by forming a work molding portion 3 by a metal sintered body S formed of Ni self-soluble alloy-Mo, as shown in FIG. 1.

The aforesaid metal sintered body S has a good depositing property relative to the base material 2, and no defect such as cracks occurs. A three-dimensional measuring machine was used to measure shapes at intervals of 50 mm in X and Y directions for comparison with the die M. Assume that the mold 1 has 300 mm of longitudinal dimension, 250 mm of lateral dimension and 180 mm of height, it has been found that there were three places which were expanded through 5 mm at the maximum, and other places were shown to be 0 to 0.3 mm of expansion, which indicate excellent precision in size. Since the alumina sheet 6 may be used to prevent the roughened surfaces of the steel balls 8 from being transferred onto the molded stacked material, good surface roughness of the metal sintered body S is obtained.

Accordingly, the mold 1 obtained through the aforementioned processes may be used immediately for press operation by subjecting the mold to simple finishing working.

The aforesaid alumina sheet 6 may be produced by the steps which will be described hereinafter.

8 wt % of synthetic resin binder 8 similar to that used to produce the above-described material sheet are added to alumina powder having a diameter of 2 to 50 m, and they are kneaded by a bench kneader for 5 minutes at normal temperature, and 3 wt % of water are added into said kneaded material.

The obtained plasticizing material is heated by a heater for 60 minutes at 120° C., and water in the synthetic resin binder is vaporized to dry the plasticizing material.

After being dried, heat is retained at approx. 80° C. and the plasticizing material in the thermoplasticized state is subjected to molding process by the similar procedure by using a roll machine similar to that used to produce the above-described material sheet to mold an alumina sheet 6 having a thickness of 1 mm. In this case, if rolls of the roll machine are heated to a temperature (approximately 80° C.) similar to that of the plasticizing material, sheet molding operation may be accomplished easily.

After molded, the alumina sheet 6 is subjected to heating treatment for 30 minutes at 80° C. to remove strains generated during the molding.

EXAMPLE III (Manufacture of a sliding member using said material sheet)

After degreasing process has been applied to the surface of a cold rolled steel plate having longitudinal and lateral dimensions of 100 mm and a thickness of 1.5 mm, two said material sheets having a thickness of 3 mm are adhered to said steel by acrylic adhesives, and the surface of the material sheet is finished smoothly to obtain a plate-like molded body.

The obtained molded body is placed in the vacuum sintering furnace to effect decomposition of organic matter and sintering of Ni self-fluxing alloy powder and Mo powder under the heating-cooling conditions similar to that shown in FIG. 3. Sintering period is 30 minutes.

A stacked body comprising the steel plate and the metal sintered body obtained through the aforementioned steps is bored with a number of bores to prepare a sliding member for a light load with the metal sintered body as a sliding surface.

The aforesaid sliding member has a good surface roughness of a sliding surface comprising a metal sintered body, has an excellent sliding performance and the metal sintered body being positively deposited on the steel plate, and therefore, peeling between layers never occurs. In this case, in order to improve the lubricating performance of the metal sintered body, it is preferred that a lubricating synthetic resin such as tetrafluoride ethylene is immersed and hardened in the sintered body or a solid lubricant such as $WS_2$, $MoS_2$ or the like is mixed into the material sheet.

In order to increase a thickness of the metal sintered body of the aforesaid sliding member, said material sheet having a thickness of 3 mm is adhered to the sintered body by acrylic resin adhesives, and the surface thereof is finished flat, after which sintering process is carried out in the manner similar to that previously described to obtain a sliding member having a metal sintered body of a double-layer construction.

In this sliding member, both the metal sintered bodies are positively deposited and no peeling between layers never occurs during the use.

EXAMPLE IV (Manufacture of a sintered body using said material sheet)

The above-described material sheet is used to mold cylindrical molded bodies $\mathbf{10}_1$ to $\mathbf{10}_3$ having a diameter of 20 mm and a length of 20 mm under pressure 1 kg/mm$^2$, which bodies are subjected to sintering process.

Figure 4:
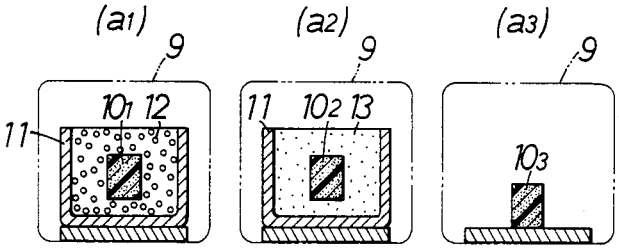
FIG. 4 illustrates the sintering process of three molded bodies in a second embodiment of the present invention.

In the sintering process, in case of the molded body $\mathbf{10}_1$, it is introduced into a container 11, as shown in FIG. 4 ($a_1$), and the molded body $\mathbf{10}_1$ is surrounded by steel balls 12 having a diameter of 0.5 to 1 mm and a linear expansion of $11\times10^{-6}$/°C. as granualr back-up bodies, the container 11 being placed in the vacuum sintering furnace 9.

In case of the molded body $\mathbf{10}_2$, it is introduced into the container 11, as shown in FIG. 4 ($a_2$), and the molded body $\mathbf{10}_2$ is surrounded by No. 5 silica sand 13 having a linear expansion of $4\times10^{-6}$/°C. as granular back-up bodies, the container being placed in the vacuum sintering furnace 9.

In case of the molded body $\mathbf{10}_3$, it is placed in the vacuum sintering furnace without back-up body, as shown in FIG. 4 ($a_3$).

Decomposition of organic matter and sintering of metal powder are carried out under the heating and cooling conditions shown in FIG. 3. In this case, in FIGS. 4 ($a_1$) and ($a_2$), since the steel balls 12 and silica sand 13 as the back-up bodies are granular, gas of formation resulting from decomposition of synthetic resin S is scattered from the back-up bodies through numberless continuous pores between the steel balls and between silica sand 13. A preferable sintering temperature is 1,120° C.

Elongations were measured with respect to lengths prior and posterior to sintering process in three sintered bodies obtained by the above-described steps, results of which are given in Table I. In this Table, sintered bodies $S_1$ to $S_3$ correspond to molded bodies $\mathbf{10}_1$ to $\mathbf{10}_3$, respectively.

TABLE I

| Sintered body | Elongation |
|---|---|
| $S_1$ | 2.2% |
| $S_2$ | 0.9% |
| $S_3$ | 3.7% |

As is apparent from Table I, in case where the molded bodies $\mathbf{10}_1$ to $\mathbf{10}_3$ are sintered, the sintered bodies $S_1$ and $S_2$ obtained using the back-up bodies 12 and 13 are restrained in expansion by receiving a pressing force of the back-up bodies 12 and 13 at the time of sintering, and therefore the elongation thereof is materially reduced as compared to that of the sintered body $S_3$ obtained by not using the back-up body.

EXAMPLE V (Manufacture of a mold for a press using said material sheet)

Figure 5:
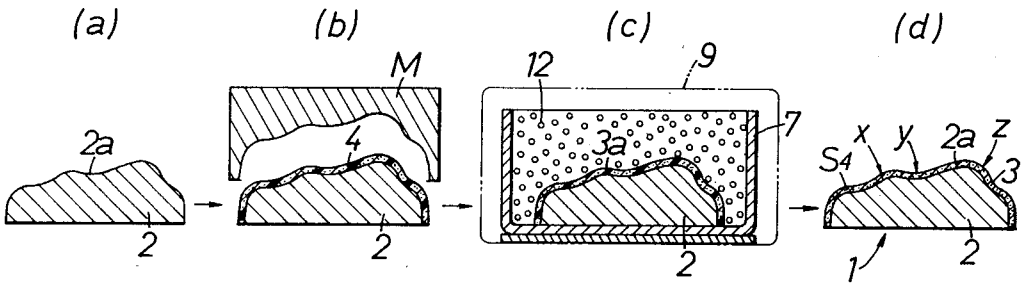
FIG. 5 illustrates the step of manufacturing a mold for a press in a third embodiment of the present invention.

As shown in FIG. 5(*a*), a base material 2 for a tank is cast from cast steel (JIS SC 46 material) similar to that of the aforementioned Example II. Since this base material 2 is cast and used, a base surface 2*a* having mill scale is coated with an acrylic adhesive after cleaning.

As shown in FIG. 5(*b*), the aforesaid material sheet 4 is stacked on and adhered to the base surface 2*a*, and this is pressed under pressure of 0.5 kg/mm$^2$ by using a die M to mold a molded body 3*a* (see FIG. 5(*c*)) having the same shape as that of the work working portion 3.

As shown in FIG. 5(*c*), the base material 2 is put into the container 7, the molded body 3*a* is surrounded by said steel balls 12 as back-up bodies, and the container 7 is placed in the vacuum sintering furnace 9 to effect decomposition of organic matter in the molded body 3*a* and sintering of Ni self-fluxing alloy-Mo powder under the above-described heating and cooling conditions of FIG. 3.

As shown in FIG. 5(*d*), there is obtained a mold 1 having a work working portion 3 comprising Ni self-fluxing alloy-Mo sintering body $S_4$ on the base surface 2*a* of the base material 2 via the above-described steps.

Elongations in a direction of thickness prior and posterior to parts x to z in the work working portion 3 of the mold 1 were measured by using a three-dimensional measuring machine, and it is evident therefrom that in the part x, elongation is 0.2 mm; in the part y, elongation is 0.5 mm; and in the part z, elongation is 0.1 mm, and a change in size of a metal sintered body $S_4$ is materially restrained by the back-up bodies 12.

Back-up bodies that may be used include the aforesaid steel balls and slica sand and in addition thereto, spherical alumina, spherical ceramics and the like. Steel balls or the like can be partly adhered by inorganic binders such as water glass so as to conform the back-up bodes to the shape of the molded body, if necessary. Molding of the molded body 3*a* in the step shown in FIG. 5(*b*) is not limited to the case where the die M is used but the material sheet 4 can be semi-hardened and then subjected to grinding working.

EXAMPLE VI 80 wt % of Ni self-fluxing alloy powder having a diameter of 10 to 60 μm and 20 wt % of Mo powder having a diameter of 10 to 53 μm are mixed to obtain a mixed powder.

A synthetic resin binder is prepared in which tetrafluoride ethylene emulsion and acrylic emulsion are mixed in the ratio of 1:1, and this synthetic resin binder in the amount of 1.5 wt % is added to the aforesaid mixed powder, which are well kneaded to obtain a plasticizing material. This plasticizing material is put into a mold for molding under pressure of 0.5 kg/mm$^2$ to obtain a cylindrical molded body having a diameter of 20 mm and a length of 20 mm.

This molded body is placed in the vacuum sintering furnace to effect decomposition of organic matter and sintering of metal powder under the heating and cooling conditions of FIG. 3. In this case, the sintering temperature is 1120° C., which is a temperature above a liquid phase line of Ni self-fluxing alloy powder, and time for sintering process is 20 minutes. Thereby, a metal sintered body is obtained from the aforementioned molding.

As a Comparative Example I, a mixed powder comprising 91 wt % of said Ni self-fluxing alloy powder and 9 wt % of said Mo powder and 1.5 wt % of said synthetic resin binder are used to mold a cylindrical molded body having the same size as that previously described to obtain a metal sintered body under the same sintering condition as that previously described. Further, as a Comparative Example II, a mixed powder comprising 69 wt % of said Ni self-fluxing alloy powder and 31 wt % of said Mo powder and 1.5 wt % of said synthetic resin binder are used to mold a cylindrical molded body having the same size as that previously described to obtain a metal sintered body under the same sintering condition as that previously described.

The shape maintaining property, change in size and sintering strength were checked with respect to the aforesaid metal sintered bodies, results of which are given in Table II.

TABLE II

| | Mo (Wt %) | Shape Maintaining property | Change in size (%) | Sintering strength |
|---|---|---|---|---|
| Present invention | 20 | Good | +3.0 | High |
| Comparative example I | 9 | Not good | −2.0 | High |
| Comparative example II | 31 | Good | +2.5 | Low |

As is apparent from Table II, the metal sintered body obtained in accordance with the present invention merely shows a minor amount of expansion and the precision of size and the shape maintaining property are good.

Figure 6:
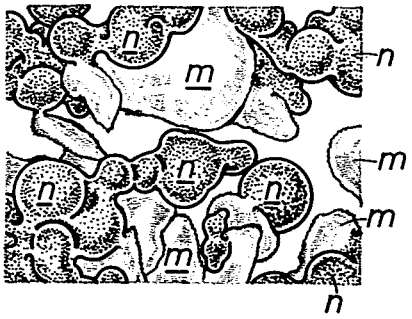
FIG. 6 is an enlarged view on the basis of a micrograph (400 magnifications) of a metal sintered body.

FIG. 6 shows an enlarged view on the basis of an optical micrograph (400 magnifications) of a metal sintered body obtained in accordance with the present invention. In the figure, a reference character m designates Mo and n designates Ni self-fluxing alloy. It is apparent from FIG. 6 that a bonding property between Ni self-fluxing alloys, an intertwining and deposition property between Mo and Ni self-fluxing alloy are good, and therefore the strength of the metal sintered body is high, for example, 4 kg/mm$^2$ of compressive strength is obtained.

In order to increase the compressive strength of the metal sintered body, synthetic resins such as epoxy resins are vacuum immersed in pore portions of the sintered body and then hardened. This processing is carried out to secure 7 kg/mm$^2$ of compressive strength. In case where the compressive strength more than the aforesaid value is required, metal having a low melting point such as Cu is molten and immersed in the metal sintered body.

EXAMPLE VII 1.5 wt % of said synthetic resin binder are added to 80 wt % of Ni self-fluxing alloy powder, 20 wt % of Mo powder and a mixed powder thereof to obtain a plurality of cylindrical molded bodies having a diameter of 20 mm and a length of 20 mm which have the same composition, shape and size as those of Example VI.

The surfaces of some of these molded bodies are formed with a shell made of a refractory material having fine continuous pores as back-up bodies. This shell is formed by immersing a molded body into a slurry of high viscosity obtained by adding alumina powder as an inorganic binder to a water suspension of zirconia silicate as a refractory material, naturally drying the obtained adhered film, and thereafter thermally drying it for one hour at 100° C.

For the purpose of comparison, a molded body of the same shape and size is obtained which merely contains Ni self-fluxing alloy powder as metal powder.

Figure 7:
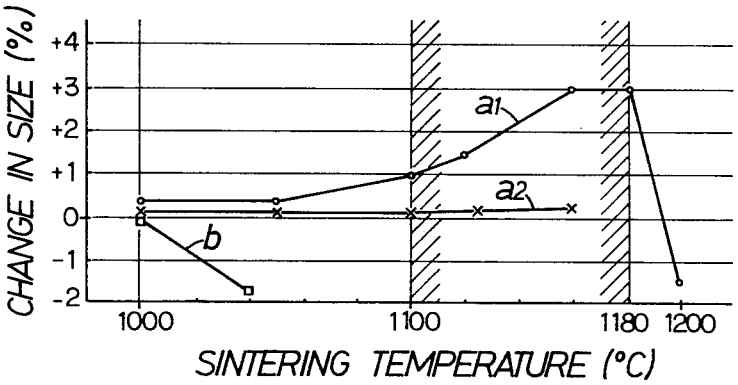
FIG. 7 is a graph showing the relation between the sintering temperature and the change in size.

FIG. 7 shows the sintering temperature and the change in size of metal sintered body where said molded body is sintered. The line $a_1$ corresponds to the case of a metal sintered body comprising Ni self-fluxing alloy and Mo and having no shell, the line $a_2$ being the case of a metal sintered body having the composition similar to that of the line $a_1$ and having a shell, and the line b being the case of a metal sintered body merely comprising Ni self-fluxing alloy.

In the figure, in the range of sintering temperature of 1100° to 1180° C. indicated by the oblique lines, the bonding property between Ni self-fluxing alloys and intertwining and deposition property thereof with Mo are good, and the change in size in the aforesaid range of temperature is restrained to +1 to +3% (expansion) in case of the metal sintered body without shell in the line $a_1$ and to +0.5% or less (expansion) in case of the metal sintered body provided with a shell in the line $a_2$. The reason why the change in size of the metal sintered body is restrained by the provision of the shell as described above is that the metal sintered body obtained in accordance with the present invention tends to expand and said expansion is impaired by the back-up effect of the shell.

On the other hand, in case of the metal sintered body merely comprising Ni self-fluxing alloy in the line b, it is apparent that if sintering takes place at a 1040° C. which is a temperature between the solid phase line and liquid phase line as in prior arts, the change in size due to the shrinkage is shown.

In the case where the present invention is applied to the manufacture of a mold for a press, the plasticizing material obtained by the aforesaid Example VI is adhered to the base material such as cast iron, cast steel, alloy steel or the like, said plasticizing material is molded into a predetermined shape and thereafter baking is applied thereto.

In this case, since the handling property of the plasticizing material is good, adhering and molding operation thereof may be accomplished easily.

While in the above-described examples, the synthetic resin binder is added to the mixed powder of the self-fluxing alloy powder and metal powder having a high melting point, it should be noted that even if the synthetic resin binder is not added, a molded body, that is, a pressed powery body can be obtained.

What is claimed is:

1. A method for manufacturing a metal sintered body, the method comprising the steps of: mixing 70 to 90 weight % of self-fluxing alloy powder and 10 to 30 weight % of metal powder of high melting point having a higher melting point than that of said self-fluxing metal powder and to which said self-fluxing alloy powder can be adhered to obtain a metal powder mixture having a sintering property; kneading 1 to 10 weight % of plastic binder with said metal powder mixture having a sintering property to obtain a molded body having a predetermined shape; and sintering said molded body at a temperature in excess of a liquid phase line of said self-fluxing alloy powder.

2. A method for manufacturing a metal sintered body according to claim 1 wherein said self-fluxing alloy powder is one of Ni self-fluxing metal powder, Fe self-fluxing alloy powder and Co self-fluxing alloy powder.

3. A method for manufacturing a metal sintered body according to claim 1 or 2 wherein said metal powder having a high melting point is one of Mo, W, stainless steel, WC, Fe-Mo (ferromolybdenum).

4. A method for manufacturing a metal sintered body according to claim 1 or 2 wherein said metal powder having a high melting point is a mixture of more than two selected from Mo, W, stainless steel, WC and Fe—Mo (ferromolybdenum).

5. A method for manufacturing a metal sintered body according to claim 1 or 2 wherein said synthetic resin binder is a mixture of tetrafluoride resin emulsion and acrylic resin emulsion.

6. A method for manufacturing a metal sintered body, the method comprising the steps of: mixing 70 to 90 weight % of self-fluxing alloy powder and 10 to 90 weight % of metal powder of high melting point having a higher melting point than that of said self-fluxing metal powder and to which said self-fluxing alloy powder can be adhered thereon to obtain a metal powder mixture having a sintering property; kneading 1 to 10 weight % of plastic binder with said metal mixture powder having a sintering property to obtain a molded body having a predetermined shape; and sintering said molded body at a temperature in excess of liquid phase line of said self-fluxing alloy powder in the state where the surface of said molded body is covered with back-up bodies.

7. A method for manufacturing a metal sintered body according to claim 6 wherein said self-fluxing alloy powder is one of Ni self-fluxing metal powder, Fe self-fluxing metal powder and Co self-fluxing alloy powder.

8. A method for manufacturing a metal sintered body according to clim 6 or 7 wherein said metal powder having a high melting point is one of Mo, W, stainless steel, WC, Fe—Mo (ferromolybdenum).

9. A method for manufacturing a metal sintered body according to claim 6 or 7 wherein said metal powder having a high melting point is a mixture of more than two selected from Mo, W, stainless steel, WC and Fe—Mo (ferromolybdenum).

10. A method for manufacturing a metal sintered body according to claim 6 or 7 wherein said synthetic resin binder is a mixture of tetrafluoride resin emulsion and acrylic resin emulsion.

11. A method for manufacturing a metal sintered body according to claim 6 or 7 wherein said back-up body is one of steel ball, slica sand, spherical alumina and spherical ceramics.

12. A method for manufacturing a metal sintered body according to claim 11 wherein an alumina sheet is interposed between said molded body and said back-up body.

13. A method for manufacturing a metal sintered body according to claim 6 or 7 wherein said back-up body is a shell made of refractory material.

14. A method for manufacturing a metal sintered body according to claim 13 wherein said back-up body is formed from a slurry having a high viscosity obtained by adding alumina powder as an inorganic binder to a water suspension of zirconia silicate as a refractory material.

15. A method for manufacturing a metal sintered body, the method comprising the steps of: mixing 70–90 weight % of self-fluxing alloy powder and 10 to 30 weight % of metal powder of high melting point having a high melting point than that of said self-fluxing metal powder and to which self-fluxing alloy powder can be adhered to obtain a metal powder mixture having a sintering property; using said metal powder mixture having a sintering property to obtain a molded body having a predetermined shape; and sintering said molded body at a temperature in excess of a liquid phase line of said self-fluxing alloy powder.

16. A material sheet for a metal sintered body comprising a metal powder mixture having a sintering property and a plastic binder including a thermoplastic synthetic resin excellent in anti-cracking property and a thermoplastic synthetic resin excellent in stacking property, wherein said metal powder mixture having a sintering property comprises a mixed powder of 70 to 90 weight % of self-fluxing metal powder and 10 to 30 weight % of metal powder having a high melting point which is higher in melting point than said self-fluxing metal powder and to which said self-fluxing metal powder can be adhered.

17. A material sheet for a metal sintered body according to claim 16 wherein said plastic binder contains 30 to 70 weight % of thermoplastic synthetic resin excellent in stacking property with respect to thermoplastic synthetic resin excellent in anti-cracking property.

18. A material sheet for a metal sintered body according to claim 16 or 17 wherein said plastic binder is added in quantity of 1 to 10 weight % to said metal powder having a sintering property.

19. A material sheet for a metal sintered body according to claim 16 wherein said self-fluxing alloy powder is one of Ni self-fluxing alloy powder, Fe self-fluxing alloy powder and Co self-fluxing alloy powder.

20. A material sheet for a metal sintered body according to claim 16 wherein said metal powder having a high melting point is one of Mo, W, stainless steel, WC and Fe—Mo (ferromolybdenum).

21. A material sheet for a metal sintered body according to claim 16 wherein said metal powder having a high melting point is a mixture of more than two selected from Mo, W, stainless steel, WC and Fe—Mo (ferromolybdenum).

22. A material sheet for a metal sintered body according to claim 16 or 17 wherein said thermoplastic synthetic resin excellent in anti-cracking property is one of tetrafluoride ethylene resin, polystyrene resin and nylon.

23. A material sheet for a metal sintered body according to claim 16 or 17 wherein said thermoplastic synthetic resin excellent in stacking property is one of acrylic resin, polyethylene resin, and butadiene vinyl acetate copolymer.

24. A material sheet for a metal sintered body according to claim 16 or 17 wherein said plastic binder is a mixture of tetrafluoride ethylene resin emulsion and acrylic resin emulsion in the ratio of 1:1.

25. A method according to claim 1 or 6 wherein after sintering, the resulting sintered body is cooled in three zones, a first zone for stabilizing the sintered body having a slow cooling rate, a second zone also having a slow cooling rate but a cooling rate greater than the said first zone, and a third zone where additional cooling takes place for cooling the sintered body to normal temperatures.

26. A method for manufacturing a self-supporting sintered body, comprising the steps of:

mixing 70 to 90 weight % of self-fluxing alloy powder and 10 to 30 weight % of metal powder of high melting point having a higher melting point than that of said self-fluxing metal powder and to which said self-fluxing alloy powder can be adhered to obtain a metal powder mixture having a sintering property; kneading 1 to 10 weight % of plastic binder with said metal powder mixture having a sintering property to obtain a molded product having a predetermined shape; and sintering said molded body at a temperature in excess of a liquid phase line of said self-fluxing alloy powder, whereby a self-supporting-metal sintered body is obtained.

* * * * *